United States Patent [19]

Haug

[11] Patent Number: 4,718,183

[45] Date of Patent: Jan. 12, 1988

[54] SNOW TILLER

[75] Inventor: Walter Haug, Blaustein, Fed. Rep. of Germany

[73] Assignee: Karl Kassbohrer Fahrzeugwerke GmbH, Ulm/Donau, Fed. Rep. of Germany

[21] Appl. No.: 895,457

[22] Filed: Aug. 11, 1986

[30] Foreign Application Priority Data

Oct. 2, 1985 [DE] Fed. Rep. of Germany ..... 8528096

[51] Int. Cl.[4] ..... E01H 4/00

[52] U.S. Cl. ..... 37/221; 172/684.5

[58] Field of Search ..... 37/219–222, 37/232, 233, 244; 172/197, 199, 200, 612, 684.5, 140, 780

[56] References Cited

U.S. PATENT DOCUMENTS

| | | | |
|---|---|---|---|
| 3,013,619 | 12/1961 | Szabo et al. | 172/612 |
| 3,685,404 | 8/1972 | Rich et al. | 37/221 |
| 3,692,120 | 9/1972 | Cline | 172/200 X |
| 3,755,930 | 9/1973 | Brandt et al. | 172/197 |
| 3,923,103 | 12/1975 | Davis et al. | 172/684.5 |
| 4,056,328 | 11/1977 | Maxey | 37/222 |
| 4,083,131 | 4/1978 | Auer et al. | 172/684.5 |
| 4,523,398 | 6/1985 | Scheidel & Haug | 37/222 |
| 4,559,725 | 12/1985 | Wieland & Haug | 37/222 |
| 4,560,303 | 12/1985 | Haug et al. | 37/219 X |

FOREIGN PATENT DOCUMENTS

| | | | |
|---|---|---|---|
| 2416634 | 10/1979 | France | 37/232 |

*Primary Examiner*—E. H. Fickholt

*Attorney, Agent, or Firm*—Samuels, Gauthier et al.

[57] ABSTRACT

The present invention relates to a snow tiller for rear-mounting on a track maintenance vehicle. The snow tiller comprises a transmission for driving at least one tiller shaft, a carrier frame for mounting the snow tiller on the track maintenance vehicle, and a baffle body of trapezoidal cross-section extending over the width of the snow tiller. A levelling attachment is secured to the underside of the baffle body facing the track surface.

With a view to facilitating repair and maintenance operations and replacement of wear components, the baffle body is formed as a tubular profile member forming a central tiller frame. The transmission is mounted at the center of the tiller frame and drives to tiller shafts laterally connected to the transmission. The ends of the tiller shafts facing away from the transmission are mounted in outer bearings secured to the ends of the tiller frame.

10 Claims, 3 Drawing Figures

SNOW TILLER

The present invention relates to a snow tiller for rearmounting on a track maintenance vehicle, comrpsing a transmission for driving at least one tiller shaft, a carrier frame for mounting the snow tiller on a track maintenance vehicle and a baffle body of trapezoidal cross-sectional shape secured to the carrier frame and extending over the width of the snow tiller, the underside of said baffle body facing the track having a levelling attachment secured thereto.

A snow tiller of this type is already known from practical use. The carrier frame of this snow tiller extends substantially over the full width thereof. Mounted on a lateral end of the carrier frame is a transmission for driving the tiller shaft likewise extending over the full width of the snow tiller. Laterally mounted on the baffle body are sideplates disposed adjacent the tiller shaft and projecting therebeyond in the direction of travel. A cover shield extending above the snow tiller is integrally connected to the baffle body.

The known snow tiller suffers from the disadvantage that the replacement of wear components such as the cover shield, the levelling attachment or the tiller shaft requires rather cumbersome operations to be carried out. As the tiller shaft extends over the full width of the snow tiller, it is difficult to handle for mounting and dismounting. Replacement of the cover shield practically requires complete disassembly of the snow tiller and the replacement of the baffle body.

In view of these disadvantages it is an object of the present invention to provide a snow tiller the handling of which is to be greatly facilitated, particularly as regards its repair and maintenance and the replacement of wear components.

This object is attained by the provision that the baffle body is a tubular profile member forming a central tiller frame, the transmission being located at the center of the tiller frame for driving two tiller shafts laterally connected to the transmission and having their ends facing away from the transmission mounted in outer bearings secured to the ends of the tiller frame, the tiller frame being formed with mounting grooves extending transversely of the direction of travel, at least one replaceable cover shield being insertably secured in an upper groove facing towards the tiller shafts, and a levelling attachment being insertably secured in at least one lower groove facing towards the track.

This solution offers substantial advantages with regard to the handling of the snow tiller. According to this solution, the baffle body forms a central frame unitto which all of the main components of the snow tiller are secured in the manner of a modular construction. Replacement for instance of the tiller shafts merely requires the outer bearings to be dismounted for permitting the tiller shaft, which is now only half the length of the conventional tiller shaft, to be removed and replaced. As the baffle body now forms the central frame of the snow tiller, it is possible to make the carrier frame for mounting the snow tiller on the track maintenance vehicle as a considerably lighter construction. The central tiller frame merely has to be bolted to the carrier frame at a reduced number of locations, so that even the replacement of the main components of the snow tiller can be accomplished in a short time. In the snow tiller embodying the invention it is of particular advantage that the cover shield, which is subject to particularly strong wear, can be simply extracted from the mounting groove to be replaced by a new cover shield. To this purpose the ends of the tiller frame are freely accessible, so that dismounting of the cover shield is no longer complicated by a transmission or other encumbering components. In the same manner it is possible to replace the levelling attachment, likewise subjected to strong wear, without requiring at least partial disassembly of the snow tiller.

In a preferred embodiment, the tiller frame is formed as an aluminum casting or extrusion. This results in the weight of the snow tiller being reduced, permitting the carrier frame to be of a considerably lighter construction.

According to a preferred embodiment, the cross-sectional shape of the tiller frame is formed as a parallelogram having a first side facing the track surface and extending substantially parallel thereto, and a second side extending from the first side upwards at an oblique angle in the direction of travel to form a baffle surface. In this embodiment it is of particular advantage that the edge portions of the parallelogram sides of the tiller frame facing the track are formed with two mounting grooves for receiving the levelling attachment therein. This permits the levelling attachment to be inserted into a pair of mutually spaced grooves, whereby the portion of the levelling attachment adjacent the tiller frame obtains a certain degree of rigidity. The provision of two mounting grooves on the parallelogram side of the tiller frame facing the track surface also permits the levelling attachment to form a continuous transition with the baffle surface of the tiller frame.

In an advantageous embodiment, a mounting groove for receiving the cover shield therein may be formed in the leading edge portion of a parallelogram side of the tiller frame facing away from the track surface and extending parallel thereto. This permits at least part of the cover shield extending over the tiller shaft to be supported on the upper parallelogram side of the tiller frame. In this context it is advantageous to employ a cover shield formed of a flexible plastic material. Depending on the type of snow being tilled, this permits the cover shield to slightly yield upwards to thereby eliminate the danger of the snow tiller being damaged by ice lumps or the like.

The replacement of the cover shield is facilitated by providing two cover shields secured in the mounting groove in symmetric relation with respect to the transmission and dimensioned so as to conform to the respective tiller shafts.

The replacement of the tiller shafts is considerably facilitated by the provision that the outer bearings are replaceably bolted to the ends of the tiller frame. The tiller shafts may then be retained by merely being inserted into the transmission and the outer bearings, so that dismounting of one of the outer bearings from the tiller frame permits the respective tiller shaft to be extracted from the transmission without requiring any further operations to be carried out for replacing the tiller shaft.

Wear of the tiller frame may be reduced by the application of a sprayed plastic layer to the baffle surface of the tiller frame.

An embodiment of the invention shall now be described in greater detail with reference to the accompanying drawings, wherein.

Figure 1:
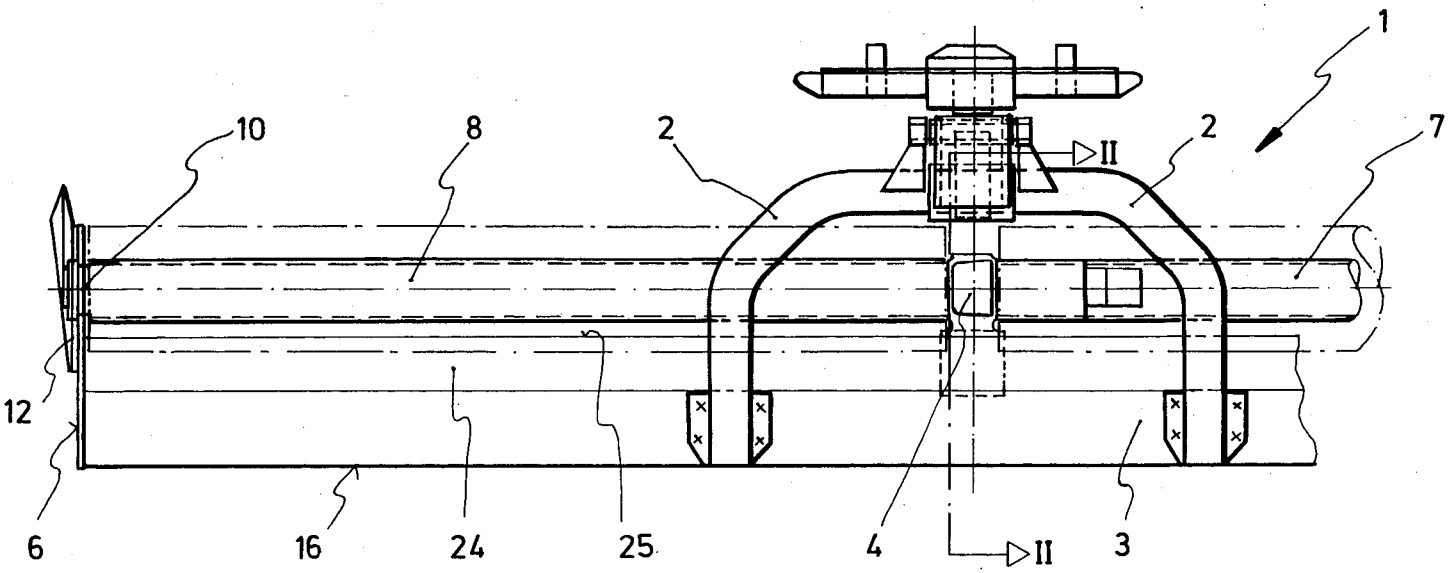
FIG. 1 shows a top plan view of a snow tiller with parts thereof broken away.

As particularly shown in FIG. 1, the snow tiller 1 comprises a carrier frame 2 for mounting it to the rear of a track maintenance vehicle (not shown), and a baffle body 3 secured to carrier frame 2 and extending over the full width of snow tiller 1.

Carrier frame 2 is of bifurcate shape and bolted to baffle body 3 at a symmetric position with respect to the center of snow tiller 1. Baffle body 3 itself is formed as a central tiller frame having the following components mounted thereon in the manner of a modular construction.

Bolted to the center of the carrier frame, or baffle body 3, respectively, is a transmission 4 for driving two tiller shafts 7 and 8 extending from both sides of transmission 4 to the lateral ends 5 and 6 of tiller frame 3. The outer ends 9 and 10 of tiller shafts 7 and 8 are retained in outer bearings 11 and 12 secured to lateral ends 5 and 6 of tiller frame 3.

Figure 2:
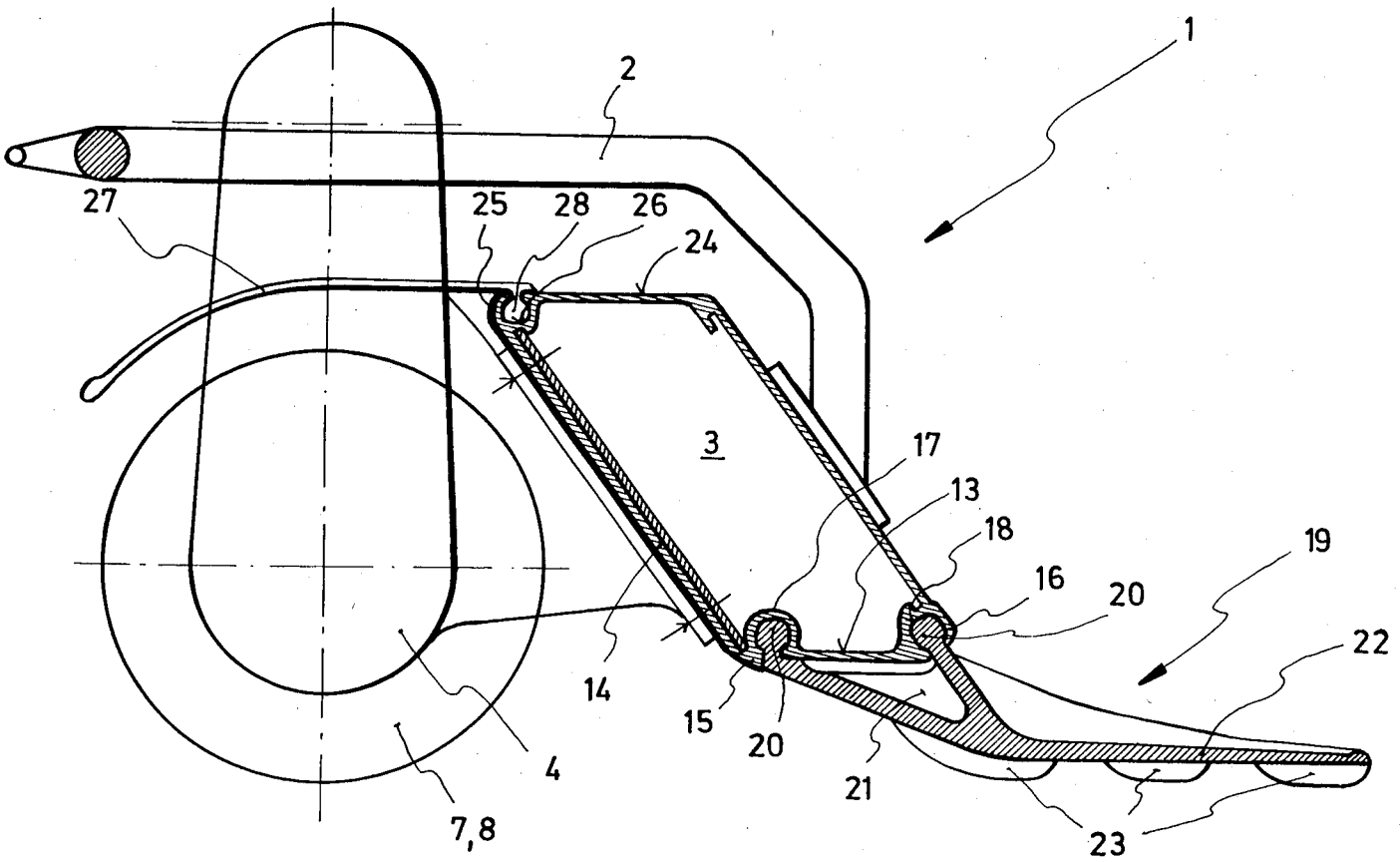
FIG. 2 shows a sectional view of the snow tiller according to the invention taken along the line II—II in FIG. 1.

As shown in greater detail in FIG. 2, tiller frame 3 is formed as a tubular member having a parallelogram profile made for instance of aluminum by extrusion. A lower parallelogram side 13 of tiller frame 3 faces the track surface and extends substantially parallel thereto. Extending obliquely upwards from the leading edge of parallelogram side 13 is a second parallelogram side 14 forming a baffle surface and provided with a wear-reducing plastic coating applied thereto as by spraying in the embodiment shown.

Formed adjacent the leading edge 15 and trailing edge 16 of first parallelogram side 13 are mounting grooves 17 and 18, respectively, extending over the full width of tiller frame 3.

A levelling attachment 19 is secured in mounting grooves 17 and 18 by having respective projections 20 inserted therein. Mounting grooves 17 and 18 are formed to receive projections 20 therein in a dovetail-type engagement, so that any additional securing of the levelling attachment is not required. Levelling attachment 19 extends over the full width of the tiller and is made of a plastic material. Its leading section is formed as a stiffened portion 21 of about triangular cross-sectional shape, from which a plateshaped and more flexible trailing portion 22 extends to the rear. On the unterside of the levelling attachment there are provided three transverse rows of relatively narrow ribs 23 extending in the direction of travel. The transverse rows of riby 23 extend over the full width of levelling attachment 19.

At the upper side 24 of tiller frame 3 opposite parallelogram side 13 a further mounting groove 26 is formed adjacent the leading edge 25 thereof to extend over the full width of tiller frame 3. Secured in maunting groove 26 is a cover shield 27 made of a flexible plastic material and extending forwards in the direction of travel in alignment with parallelogram side 24 to terminate in an arcuate end portion directed towards the track surface. In the same manner as levelling attachment 19, cover shield 27 is formed with a projection 28 adapted to be received in mounting groove 26 in a dovetail-type engagement, so that further fastening of cover shield 27 is not required. There are two cover shields 27 provided, each of which extends from transmission 4 to the respective outer end 5 or 6 of tiller frame 3.

Figure 3:
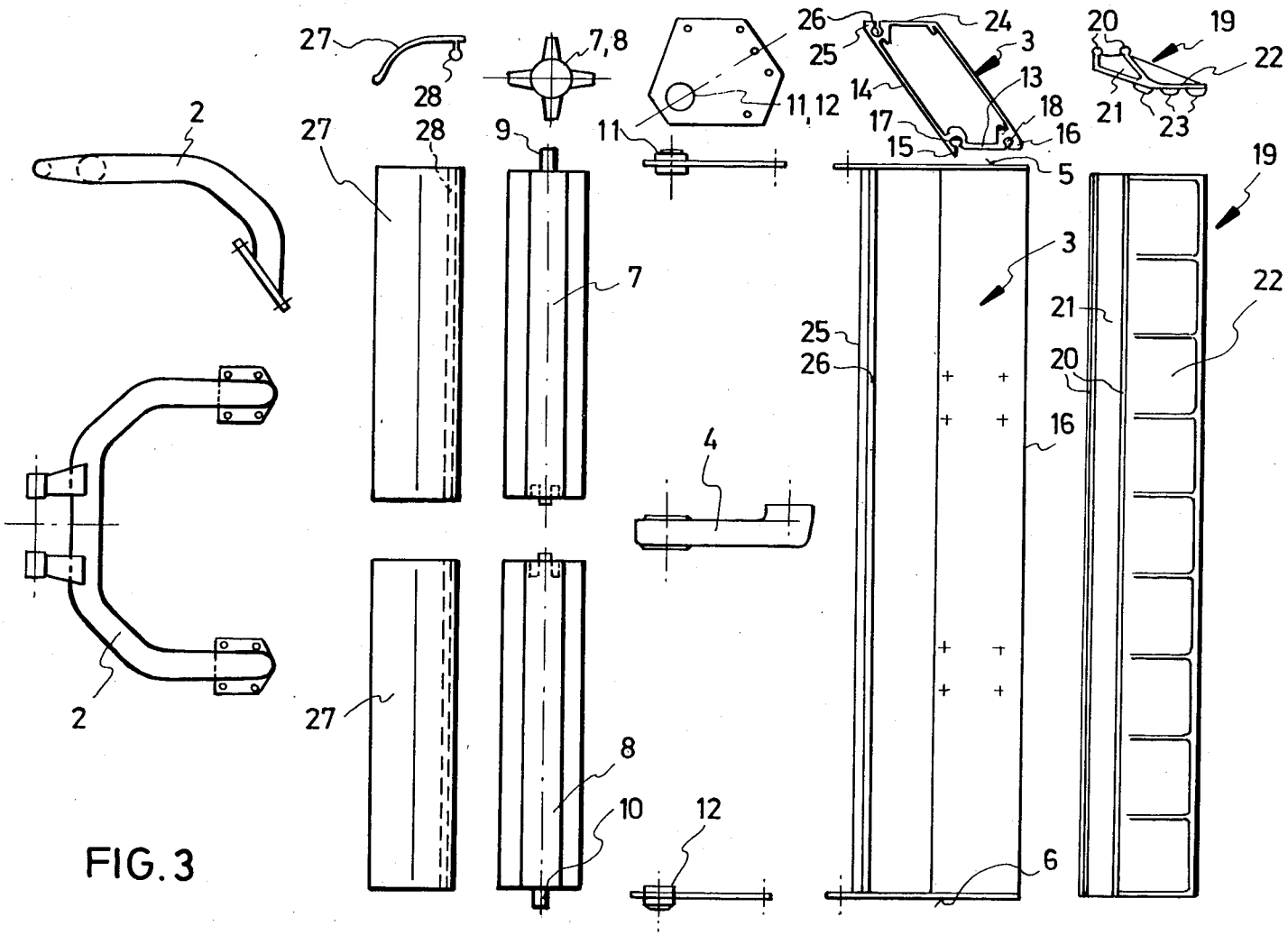
FIG. 3 shows exploded side- and top plan views of the snow tiller according to the invention.

Tiller shafts 7 and 8 have one of their ends inserted into transmission 4, and the other ends into outer bearings 11 and 12, respectively, bolted to outer ends 5 and 6 of tiller frame 3, as shown in FIG. 1. Shown in FIG. 3 is an exploded top plan view of the individual components of snow tiller 1, with respective sideviews thereof being also depicted. From this figure it is evident that snow tiller 1 is composed of a small number of parts which are readily replaceable. All wear components are mounted on central tiller frame 3, so that, depending on the wear of the snow tiller, either tiller frame 3 may be bodily dismounted from carrier frame 2 to be replaced by a new one, or individual wear components may be replaced.

The operation of the invention shall now be explained in greater detail:

Levelling attachment 19 is by nature a wear component and can be dismounted from tiller frame 3 by simply pulling it out of mounting grooves 17 and 18 for replacement by a new levelling attachment 19 inserted thereinto. Cover shields 27 can be replaced in the same manner. For replacing a worn tiller shaft, all that is required is to dismount the respective outer bearing 11 or 12, whereupon the worn tiller shaft 7 or 8, respectively, can be extracted from transmission 4. The installation of a new tiller shaft is carried out by the reverse procedure.

It is also possible to provide the top side 24 of tiller frame 3 with two mounting grooves for securing the cover shield, as in the case of lower parallelogram side 13. In this case the cover shield would have to be formed with two projections. Lateral ends 5 and 6 of tiller frame 3 may be closed by end plates which might at the same time function to secure the two cover shields as well as the levelling attachment in the lateral direction.

I claim:

1. A snow tiller for rear-mounting on a track maintenance vehicle, comprising a transmission for driving at least one tiller shaft, a carrier frame for mounting the snow tiller on the track maintenance vehicle, and a baffle body of trapezoidal cross-sectional shape secured to the carrier frame and extending over the width of the snow tiller, the underside of the baffle body facing the track surface having a levelling attachment secured thereto, said baffle body being formed as a tubular profile member and forming a central tiller frame, said transmission being mounted at the center of said tiller frame for driving two tiller shafts laterally connected to said transmission and having their ends facing away from the transmission mounted in outer bearings secured to the ends of said tiller frame, said tiller frame being formed with mounting grooves extending transversely of the direction of travel, at least one replaceable cover shield being insertably secured in an upper groove facing towards said tiller shafts, and a levelling attachement being insertably secured in at least one lower groove facing the track surface.

2. A snow tiller according to claim 1, wherein said tiller frame is made as a continuous casting or extrusion of aluminum.

3. A snow tiller according to claim 1 wherein said tiller frame is of parallelogram shape in cross-section, comprising a first parallelogram side facing the track surface and extending substantially parallel thereto, and a second parallelogram side extending obliquely upwards from said first side in the direction of travel to form a baffle surface.

4. A snow tiller according to claim 3, wherein the edge portions of the first parallelogram side of said tiller frame are formed with two mounting grooves for receiving said levelling attachment therein.

5. A snow tiller according to claim 3 wherein the leading edge portion of a parallelogram side of said tiller frame facing away from the track surface and extending parallel thereto is formed with a mounting groove for securing a cover shield therein.

6. A snow tiller according to claim 5 wherein said cover shield is made of a flexible plastic material.

7. A snow tiller according to any one of claims 5 or 6 wherein two cover shields having dimensions conforming to those of said tiller shafts are secured in said mounting groove in symmetric relation with respect to said transmission.

8. A snow tiller according to claim 1 wherein said outer bearings for said tiller shafts are replaceably bolted to said tiller frame.

9. A snow tiller according to any one of claims 1, 2, 3, 4, 5, 6 or 8 wherein said tiller shafts are retained by having their respective ends inserted into said transmission and said outer bearings.

10. A snow tiller according to any one of claims 1, 2, 3, 4, 5, 6 or 8 wherein a plastic coating is spray-deposited on the second parallelogram side of said tiller frame.

* * * * *